US010508001B2

(12) United States Patent
Kitajima

(10) Patent No.: US 10,508,001 B2
(45) Date of Patent: Dec. 17, 2019

(54) ELEVATOR SYSTEM

(71) Applicant: Mitsubishi Electric Corporation, Chiyoda-ku (JP)

(72) Inventor: Kenta Kitajima, Aichi (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 424 days.

(21) Appl. No.: 15/537,530

(22) PCT Filed: Mar. 20, 2015

(86) PCT No.: PCT/JP2015/058554

§ 371 (c)(1),
(2) Date: Jun. 19, 2017

(87) PCT Pub. No.: WO2016/151694

PCT Pub. Date: Sep. 29, 2016

(65) Prior Publication Data

US 2017/0341904 A1 Nov. 30, 2017

(51) Int. Cl.
*B66B 5/02* (2006.01)
*B66B 5/00* (2006.01)

(52) U.S. Cl.
CPC ..... *B66B 5/0018* (2013.01); *B66B 5/02* (2013.01); *B66B 2201/30* (2013.01)

(58) Field of Classification Search
CPC ..... B66B 5/0018; B66B 5/02; B66B 2201/30; B66B 7/1238
USPC ..... 187/393
See application file for complete search history.

(56) References Cited

U.S. PATENT DOCUMENTS

| | | | | |
|---|---|---|---|---|
| 9,067,761 | B2 * | 6/2015 | Ropponen | B66B 7/06 |
| 9,096,411 | B2 * | 8/2015 | Benosman | B66B 7/06 |
| 9,242,838 | B2 * | 1/2016 | Benosman | B66B 7/06 |
| 9,327,942 | B2 * | 5/2016 | Fukui | B66B 5/0031 |
| 9,359,172 | B2 * | 6/2016 | Mangini | B66B 5/021 |
| 9,434,577 | B2 * | 9/2016 | Benosman | B66B 5/02 |
| 9,475,674 | B2 * | 10/2016 | Benosman | B66B 7/06 |
| 9,676,592 | B2 * | 6/2017 | Wells | B66B 5/022 |
| 10,407,275 | B2 * | 9/2019 | Khalil | B66B 5/0031 |
| 2010/0140023 | A1 * | 6/2010 | Fukui | B66B 5/02 187/292 |

(Continued)

FOREIGN PATENT DOCUMENTS

| | | |
|---|---|---|
| JP | 2009-166939 A | 7/2009 |
| JP | 2014-105066 | 6/2014 |
| WO | 2010/013597 A1 | 2/2010 |

OTHER PUBLICATIONS

International Search Report dated Jun. 23, 2015 in PCT/JP2015/058554 filed Mar. 20, 2015.

(Continued)

*Primary Examiner* — David S Warren
(74) *Attorney, Agent, or Firm* — Oblon, McClelland, Maier & Neustadt, L.L.P.

(57) ABSTRACT

An elevator system includes a car, a main rope, a car, a detector, and a sway detection unit. The car moves vertically. The main rope moves as the car moves. The car moves vertically. The detector is provided on the car. The detector detects the position of the main rope. The sway detection unit detects, on the basis of the position detected by the detector, that abnormal swaying requiring a control operation is occurring in the main rope.

9 Claims, 8 Drawing Sheets

(56) References Cited

U.S. PATENT DOCUMENTS

| | | | | |
|---|---|---|---|---|
| 2013/0048438 | A1* | 2/2013 | Mangini | B66B 7/06 187/414 |
| 2013/0133983 | A1* | 5/2013 | Mangini | B66B 7/06 187/277 |
| 2013/0173206 | A1* | 7/2013 | Benosman | B66B 7/06 702/141 |
| 2013/0213742 | A1* | 8/2013 | Hakala | B66B 1/24 187/247 |
| 2013/0275081 | A1* | 10/2013 | Benosman | B66B 7/06 702/150 |
| 2014/0000985 | A1* | 1/2014 | Fukui | B66B 5/0031 187/247 |
| 2014/0069747 | A1* | 3/2014 | Benosman | B66B 7/06 187/414 |
| 2014/0224590 | A1* | 8/2014 | Puranen | B66B 5/022 187/247 |
| 2016/0272463 | A1* | 9/2016 | Benosman | B66B 5/0018 |
| 2016/0376125 | A1* | 12/2016 | Wells | B66B 5/022 187/266 |
| 2017/0341904 | A1* | 11/2017 | Kitajima | B66B 5/02 |
| 2018/0016117 | A1* | 1/2018 | Palazzola | B66B 5/02 |
| 2018/0105393 | A1* | 4/2018 | Miyajima | B66B 7/1238 |
| 2018/0305176 | A1* | 10/2018 | Miyajima | B66B 5/0031 |
| 2019/0210832 | A1* | 7/2019 | Toutaoui | B66B 1/28 |

OTHER PUBLICATIONS

International Preliminary Report on Patentability and Written Opinion dated Oct. 5, 2017 in PCT/JP2015/058554.

* cited by examiner

[Fig. 1]
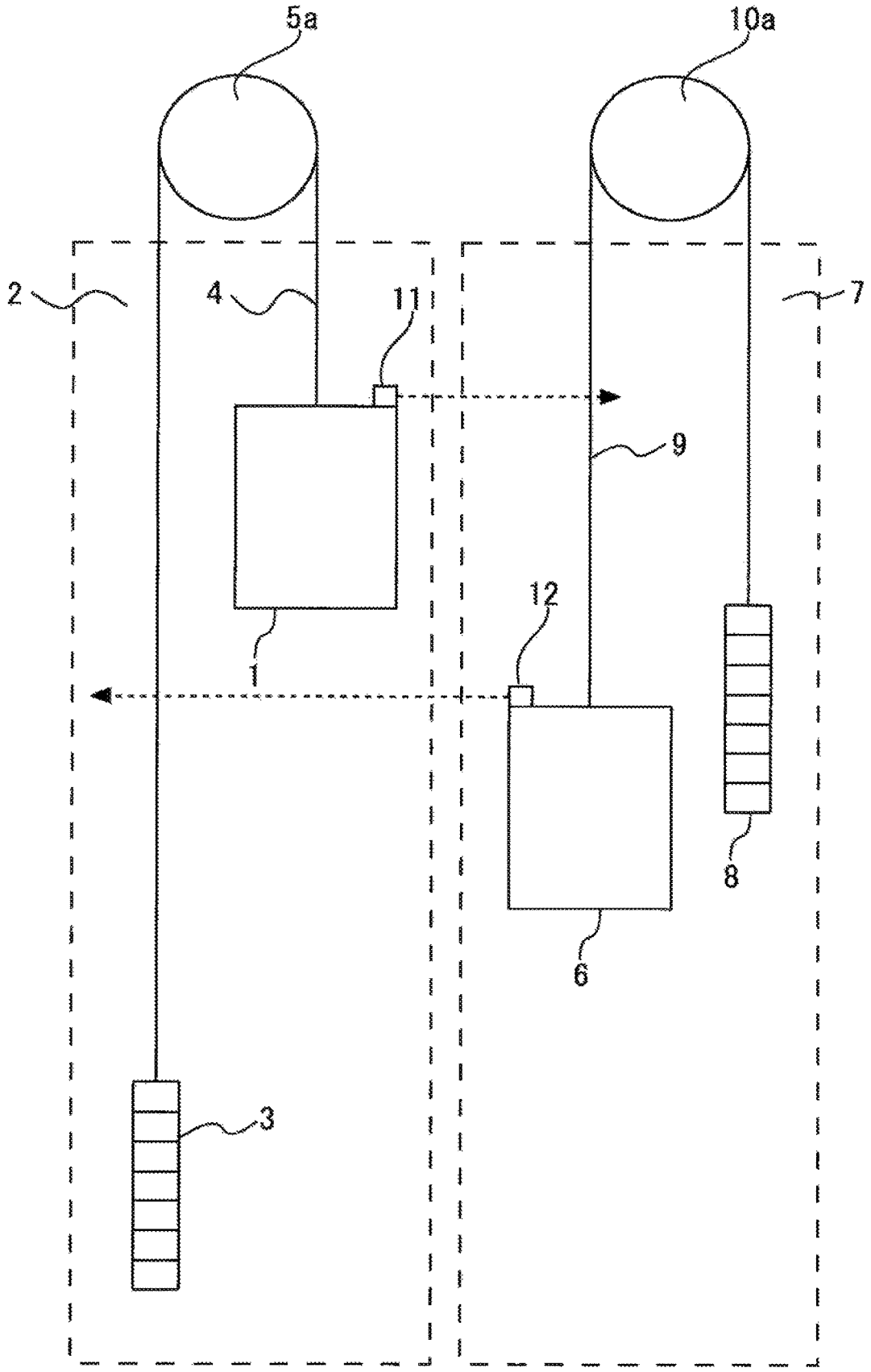

[Fig. 2]
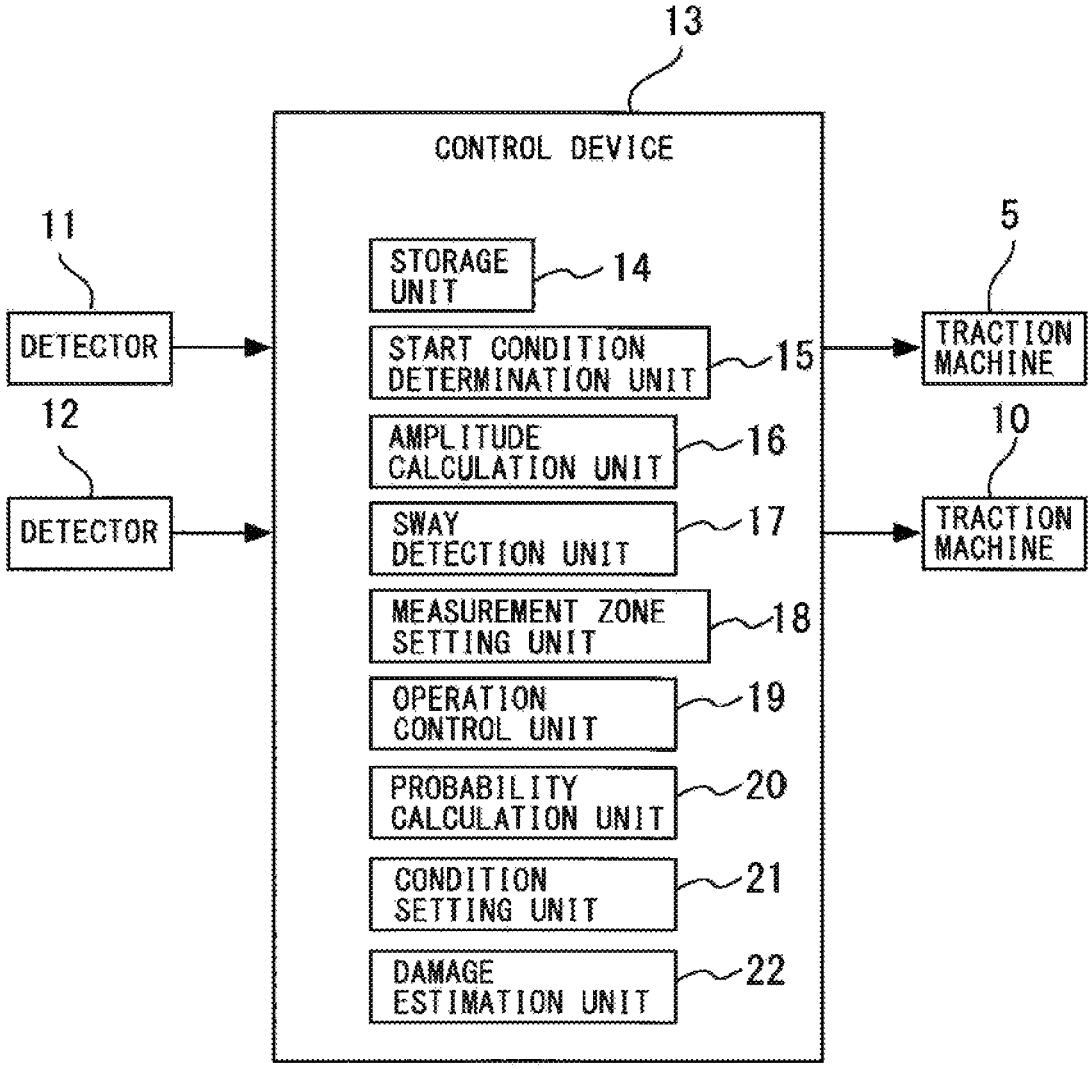

[Fig. 3]
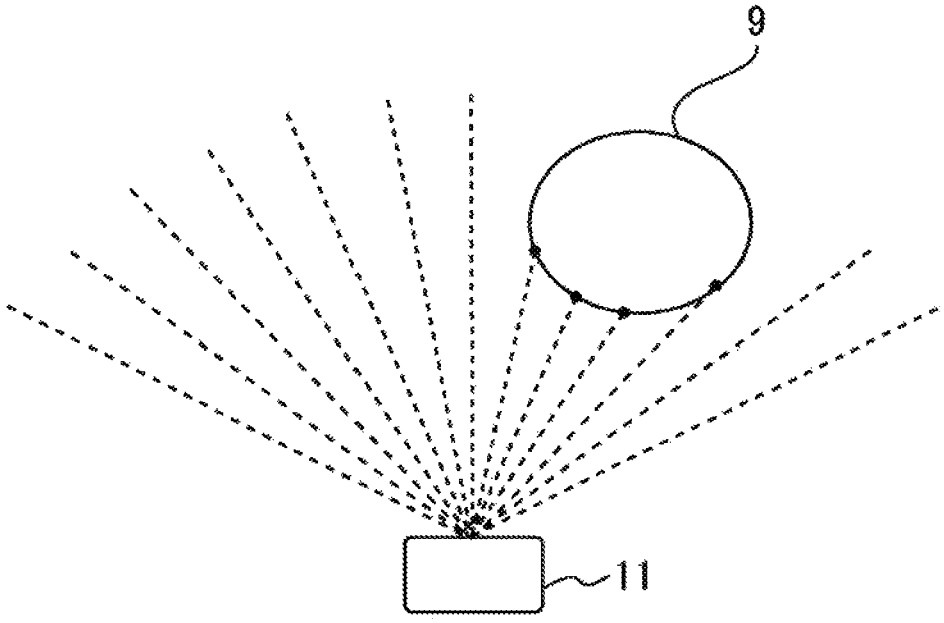

[Fig. 4]
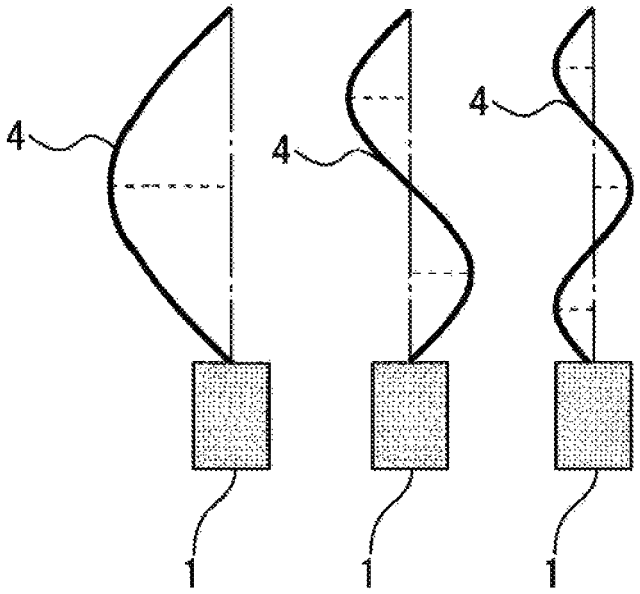
[Fig. 5]
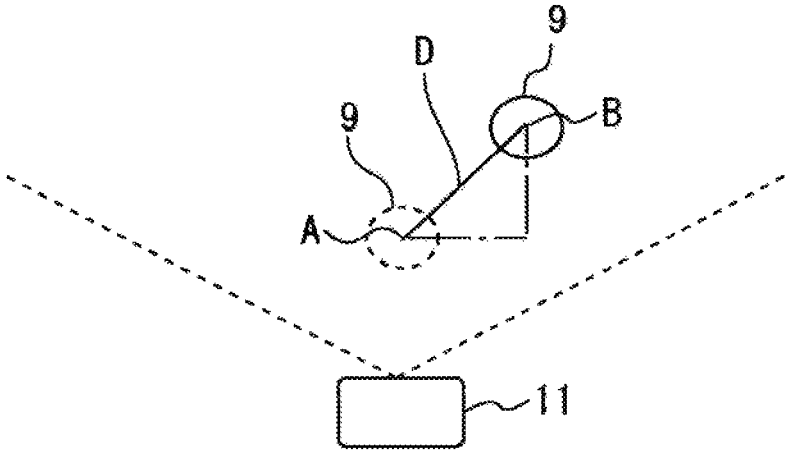

[Fig. 6]
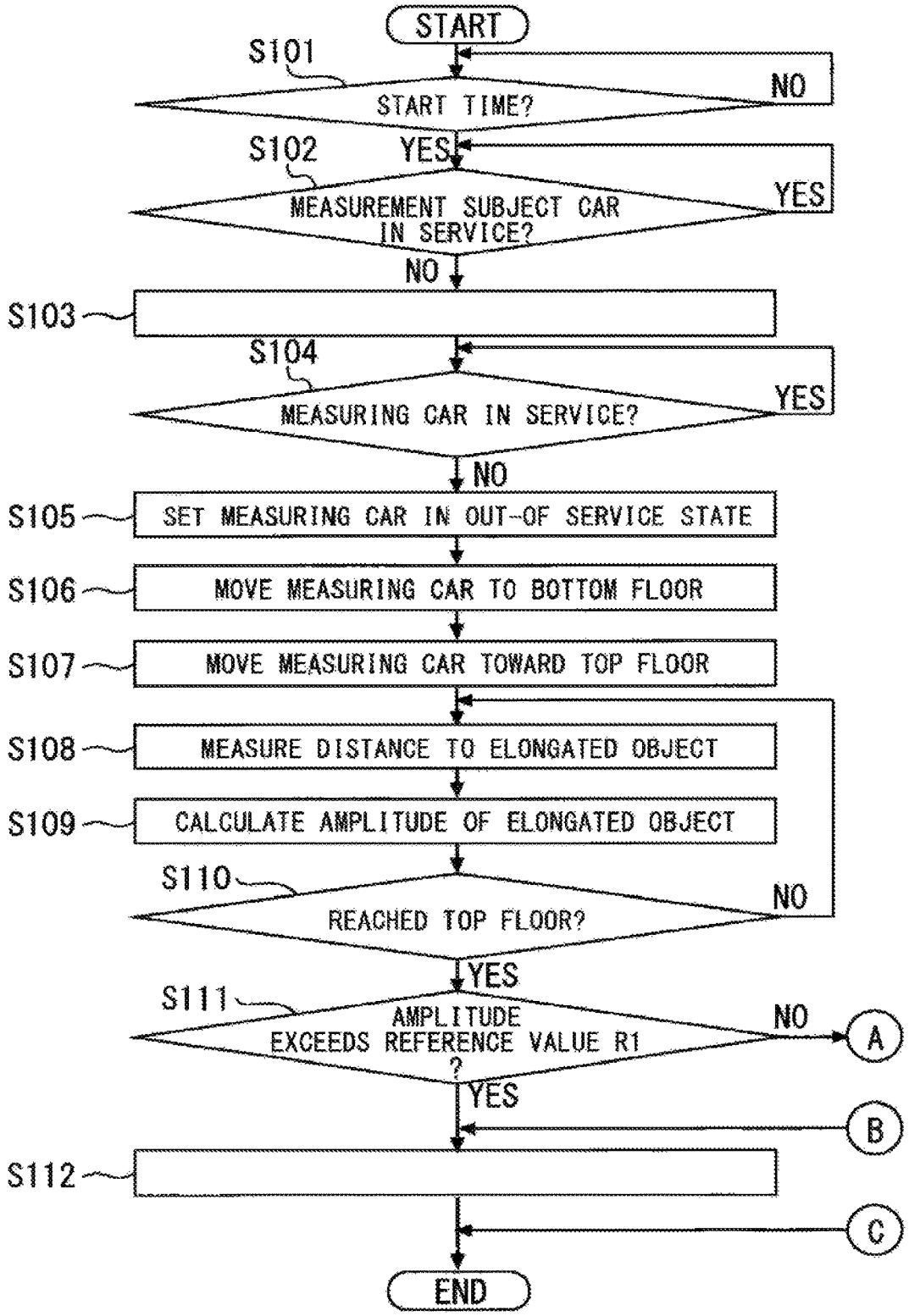
S103:SET MEASUREMENT SUBJECT CAR IN OUT-OF SERVICE STATE
S112:SHIFT TO OPERATION PERFORMED AFTER DETECTING LONG PERIOD VIBRATION

[Fig. 7]
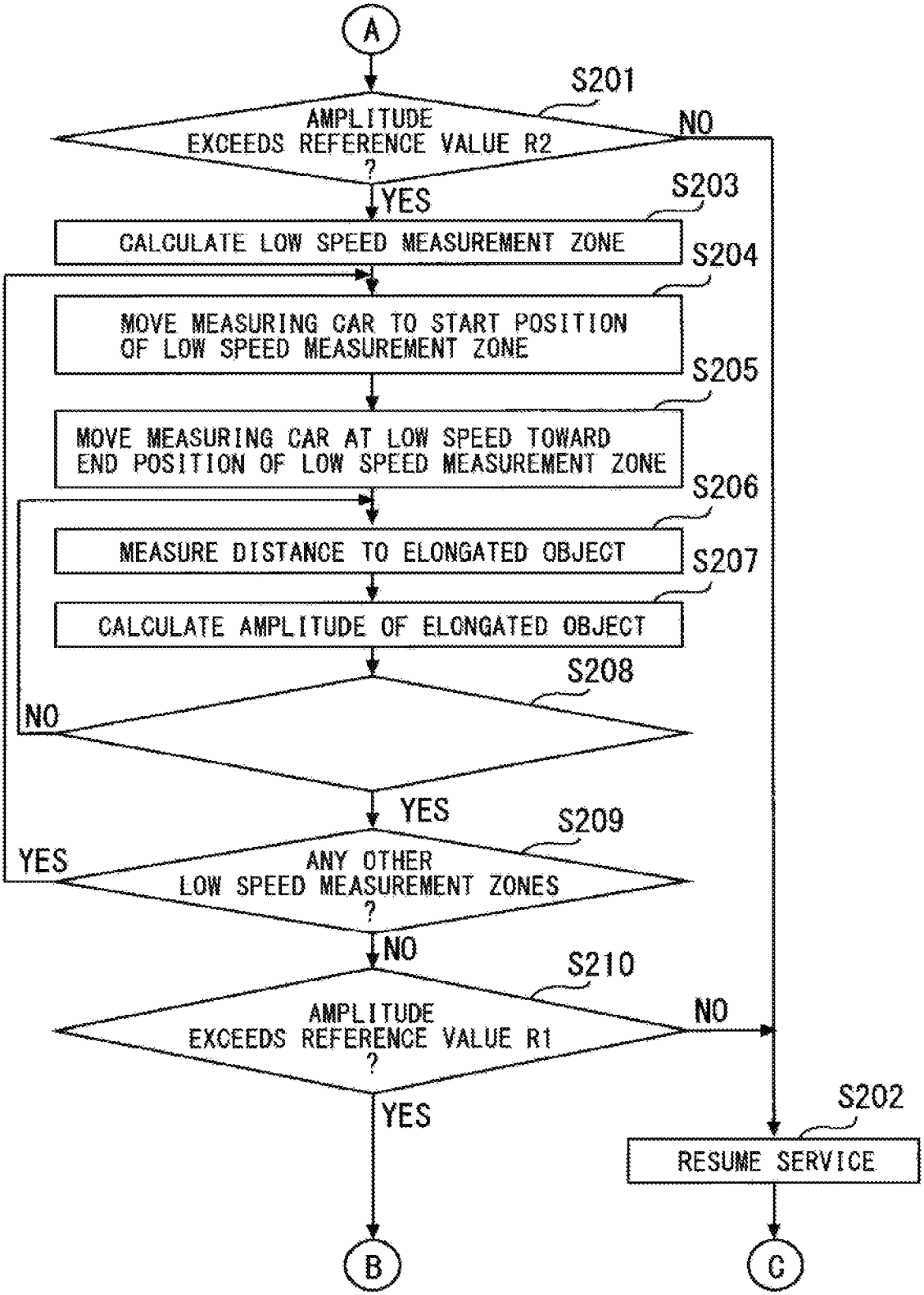
S208: REACHED END POSITION OF LOW SPEED MEASUREMENT ZONE?

[Fig. 8]
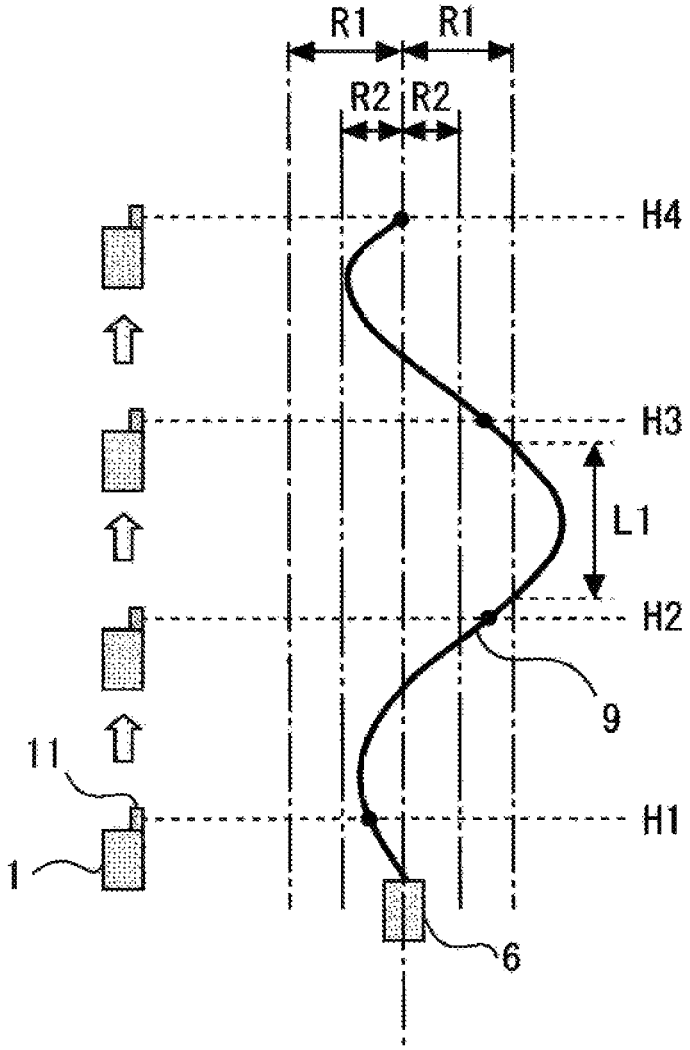

[Fig. 9]
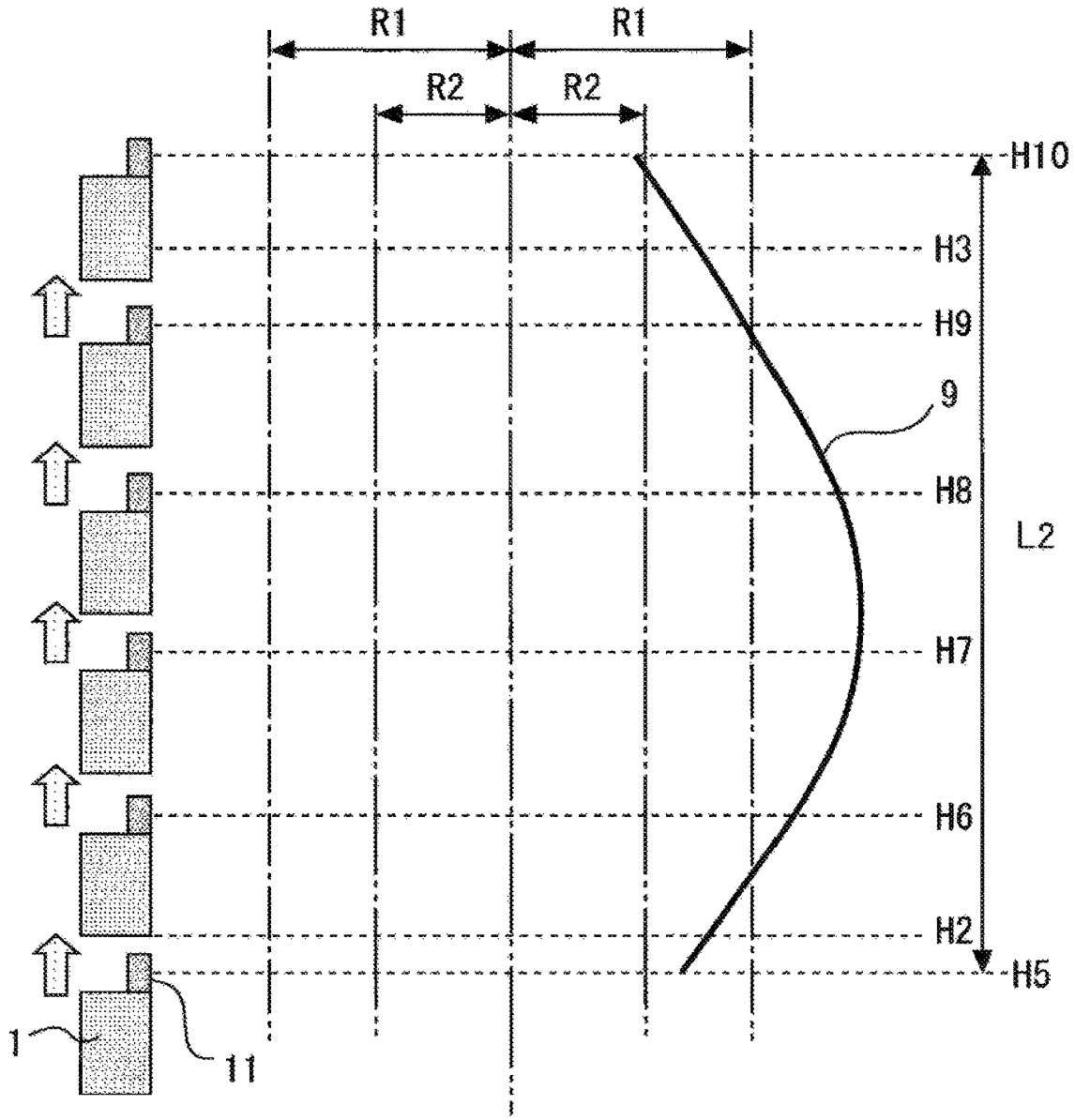
[Fig. 10]
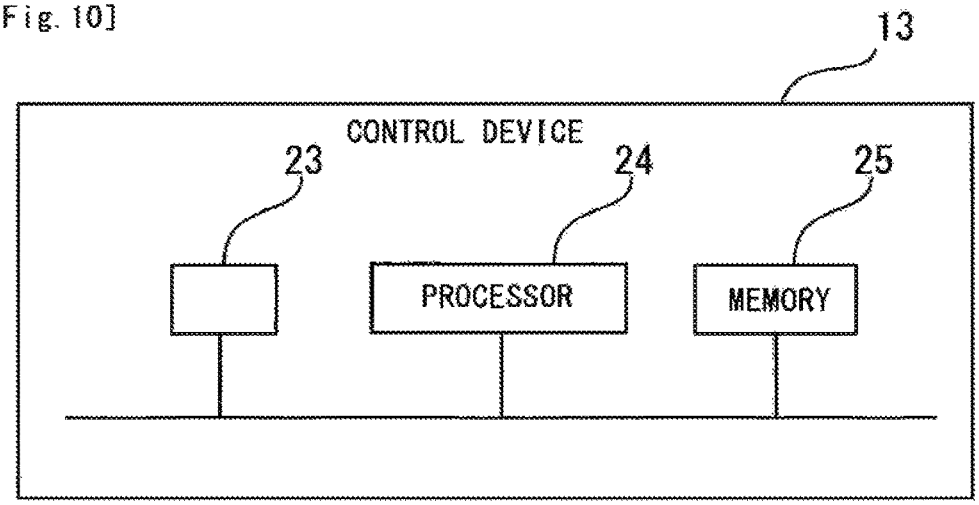

ELEVATOR SYSTEM

FIELD

The present invention relates to an elevator system.

BACKGROUND

Patent Literature 1 describes an elevator system. In the system described in Patent Literature 1, a sensor is provided on a car. The car is suspended in a shaft by a main rope. The sensor detects vibration of the main rope.

CITATION LIST

Patent Literature

PTL 1: WO 2010/013597

SUMMARY

Technical Problem

In the system described in Patent Literature 1, vibration of the main rope, from which the car is suspended, is detected by the sensor provided on the car itself. The measurement precision of the sensor decreases steadily as the measurement distance increases. With the system described in Patent Literature 1, therefore, vibration of the main rope can be detected with a high degree of precision only in positions close to the car.

The present invention has been made in order to solve such a problem. An object of the present invention is to provide an elevator system with which swaying of an elongated object can be detected with a high degree of precision.

Solution of Problem

An elevator system according to the invention comprises a first car that moves vertically, an elongated object that moves as the first car moves, a second car that moves vertically, a detector provided on the second car in order to detect a position of the elongated object, and sway detecting means for detecting, on the basis of the position detected by the detector, that abnormal swaying requiring a control operation is occurring in the elongated object.

Advantageous Effects of Invention

With the elevator system according to the present invention, swaying of an elongated object can be detected with a high degree of precision.

BRIEF DESCRIPTION OF DRAWINGS

FIG. 1 is a diagram showing an example configuration of an elevator system according to a first embodiment of the present invention.

FIG. 2 is a block diagram showing a system configuration.

FIG. 3 is a diagram for explaining a position detection function of a detector.

FIG. 4 is a diagram for explaining swaying which occurs in an elongated object.

FIG. 5 is a diagram for explaining an amplitude calculation function of a control device.

FIG. 6 is a flowchart showing an example operation of the elevator system according to the first embodiment of the present invention.

FIG. 7 is a flowchart showing an example operation of the elevator system according to the first embodiment of the present invention.

FIG. 8 is a diagram for explaining a sway determination function of the control device.

FIG. 9 is a diagram for explaining the sway determination function of the control device.

FIG. 10 is a diagram showing hardware components of the control device.

DESCRIPTION OF EMBODIMENTS

The present invention will be described with reference to the accompanying drawings. Redundant descriptions will be simplified or omitted as appropriate. In each of the drawings, the same reference signs refer to the same or comparable parts.

First Embodiment

FIG. 1 is a diagram showing an example configuration of an elevator system according to a first embodiment of the present invention. FIG. 1 shows a system including two cars as an example. The system may include three or more cars.

A car 1 moves vertically in a shaft 2. The shaft 2 is a space, for example, formed inside a building so as to extend vertically. A counterweight 3 moves vertically in the shaft 2 in a direction opposite to the direction in which the car 1 moves. The car 1 and the counterweight 3 are suspended in the shaft 2 by a main rope 4. The roping method used to suspend the car 1 is not limited to the example shown in FIG. 1.

The main rope 4 is wound around a driving sheave 5*a* of a traction machine 5. When the driving sheave 5*a* rotates, the main rope 4 moves in a direction corresponding to the rotation direction of the driving sheave 5*a*. When the main rope 4 moves in a lengthwise direction, the car 1 either ascends or descends.

A car 6 moves vertically in a shaft 7. The shaft 7 is a space, for example, formed inside the building so as to extend vertically. The shaft 7 is adjacent to the shaft 2. A counterweight 8 moves vertically in a shaft 7 in a direction opposite to the direction in which the car 6 moves. The car 6 and the counterweight 8 are suspended in a shaft 7 by a main rope 9. The roping method used to suspend the car 6 is not limited to the example shown in FIG. 1.

The main rope 9 is wound around a driving sheave 10*a* of a traction machine 10. When the driving sheave 10*a* rotates, the main rope 9 moves in a direction corresponding to the rotation direction of the driving sheave 10*a*. When the main rope 9 moves in a lengthwise direction, the car 6 either ascends or descends.

A detector 11 is provided on the car 1. The detector 11 detects the position of an elongated object that moves as the car 6 moves. In the example illustrated in this embodiment, the detector 11 detects the position of the main rope 9. Since the detector 11 is provided on the car 1, the height at which the detector 11 is disposed varies as the car 1 moves. The detector 11 detects the position of the main rope 9 at the height at which the detector 11 is disposed, for example. Elongated objects such as a control cable, a compensating rope, and a governor rope are connected to the car 6 in addition to the main rope 9. The position detection subject of the detector 11 may be an elongated object other than the main rope 9.

A detector 12 is provided on the car 6. The detector 12 detects the position of an elongated object that moves as the car 1 moves. In the example illustrated in this embodiment, the detector 12 detects the position of the main rope 4. Since the detector 12 is provided on the car 6, the height at which the detector 12 is disposed varies as the car 6 moves. The detector 12 detects the position of the main rope 4 at the height at which the detector 12 is disposed, for example. Elongated objects such as a control cable, a compensating rope, and a governor rope are connected to the car 1 in addition to the main rope 4. The position detection subject of the detector 12 may be an elongated object other than the main rope 4.

FIG. 2 is a block diagram showing a system configuration. The detectors 11 and 12 are electrically connected to a control device 13. Information indicating the position detected by the detector 11 is input into the control device 13. Information indicating the position detected by the detector 12 is input into the control device 13.

Any method may be employed as the method by which the detector 11 detects the position of the main rope 9. FIG. 3 is a diagram for explaining a position detection function of the detector 11. FIG. 3 is a plan view taken at a height that includes the detector 11. For example, the detector 11 emits laser beams in a horizontal direction and receives reflected beams. FIG. 3 shows an example in which the detector 11 emits laser beams at fixed angle intervals. The detector 11 may emit ultrasonic waves. When the direction (the angle) of the laser beams emitted by the detector 11 and the time required for the detector 11 to receive the reflected beams after emitting the laser beams are known, the position of the main rope 9 relative to the detector 11 can be detected. The detector 11 outputs in information indicating the angle and information indicating the time, for example, to the control device 13 as information indicating the position of the main rope 9.

The detector 12 has similar functions to the functions of the detector 11. Detailed description of the functions of the detector 12 has been omitted.

The traction machines 5 and 10 are electrically connected to the control device 13. The traction machine 5 is controlled by the control device 13. In other words, movement of the car 1 is controlled by the control device 13. The traction machine 10 is controlled by the control device 13. In other words, movement of the car 6 is controlled by the control device 13. FIG. 2 shows an example in which the control device 13 functions as both a controller for controlling each of the elevators and a group controller for managing a plurality of the controllers.

The control device 13 has a function for detecting that the elongated object is swaying abnormally. In the example illustrated in this embodiment, the control device 13 detects that the main rope 9 is swaying abnormally on the basis of the position detected by the detector 11. The control device 13 detects that the main rope 4 is swaying abnormally on the basis of the position detected by the detector 12.

The abnormal swaying detected by the control device 13 is swaying requiring a control operation. For example, when the main rope 9 is swaying abnormally, the control device 13 implements a control operation on the elevator having the car 6. When the main rope 4 is swaying abnormally, the control device 13 implements a control operation on the elevator having the car 1.

FIG. 4 is a diagram for explaining swaying which occurs in an elongated object. In FIG. 4, the main rope 4 is shown as an example of the elongated object. During an earthquake or in strong wind, the building some times sways slowly and continuously for a long time at a low order (a first order, for example) natural frequency. This swaying is not detected by a normal seismic sensor. When the building sways, the main rope 4 sways. When the natural frequency of the swaying main rope 4 matches the natural frequency of the building, the main rope 4 resonates. When the amplitude of the main rope 4 increases, the main rope 4 may come into contact with or catch on a device, leading to a fault. The control operation is implemented to prevent such a fault from occurring.

For example, when the main rope 4 sways abnormally, a control operation is started in the elevator having the car 1. In the control operation, the car 1 is stopped on a non-resonant floor, for example. The non-resonant floor is a floor on which the elongated object is unlikely to resonate with the swaying of the building even when the car 1 is stopped. The non-resonant floor is set in advance. During the control operation, the car 1 may be moved repeatedly such that tension is exerted continuously on the elongated object.

To realize these functions, the control device 13 includes, for example, a storage unit 14, a start condition determination unit 15, an amplitude calculation unit 16, a sway detection unit 17, a measurement zone setting unit 18, and an operation control unit 19.

Information required by the control device 13 to implement control is stored in the storage unit 14.

The start condition determination unit 15 determines whether or not a start condition is established. The start condition is a condition on which processing for detecting abnormal swaying occurring in the elongated object is started. This processing will be referred to hereafter as "abnormality determination processing".

The amplitude calculation unit 16 calculates an amplitude of the swaying occurring in the elongated object. For example, the amplitude calculation unit 16 calculates the amplitude of the main rope 9 on the basis of the position detected by the detector 11. The amplitude calculation unit 16 calculates the amplitude of the main rope 4 on the basis of the position detected by the detector 12.

FIG. 5 is a diagram for explaining an amplitude calculation function of the control device 13. FIG. 5 is a plan view taken at a height that includes the detector 11. In FIG. 5, a broken line shows the main rope 9 when the main rope 9 is not swaying. In FIG. 5, a solid line shows the main rope 9 when the main rope 9 is swaying.

A position A of the main rope 9 when not swaying is stored in advance in the storage unit 14. A position B of the main rope 9 when swaying is detected by the detector 11. The amplitude calculation unit 16 calculates a distance D between the position A and the position B as the amplitude of the main rope 9. In a case where the main rope 9 is disposed diagonally, a plurality of pieces of information or a calculation formula from which to determine the position A may be stored in advance in the storage unit 14. Information indicating a height required to determine the position A can be determined from the output of an encoder included in the traction machine 5, for example. Further, the position of the main rope 9 may be measured in advance, and the measurement result may be stored in the storage unit 14.

The sway detection unit 17 detects that the elongated object is swaying abnormally. In the example illustrated in this embodiment, the sway detection unit 17 detects that the main rope 4 or 9 is swaying abnormally on the basis of the amplitude calculated by the amplitude calculation unit 16.

The measurement zone setting unit 18 sets a zone in which position detection (measurement) is performed by the detector.

The operation control unit 19 controls operations of devices included in the system. For example, the operation control unit 19 controls an operation of the traction machine 5. The operation control unit 19 controls an operation of the traction machine 10.

Next, referring to FIGS. 6 to 9, an example operation of the system will be described specifically. FIGS. 6 and 7 are flowcharts showing an example operation of the elevator system according to the first embodiment of the present invention.

The start condition determination unit 15 determines whether or not the start condition is established. For example, the start condition determination unit 15 determines whether or not a current time corresponds to a start time (S101). The start time is set in advance. In S101, a determination regarding an elapsed time following the previous abnormality determination processing may be performed. For example, when the abnormality determination processing is set to be implemented once per hour, the start condition determination unit 15 determines in S101 whether or not an hour has elapsed following the previous abnormality determination processing.

When the current time corresponds to the start time, the start condition determination unit 15 determines whether or not the measurement subject car is in service (S102). For example, when a passenger is riding in the measurement subject car, the measurement subject car is determined to be in service. When the measurement subject car responds to a call, the measurement subject car is determined to be in service.

When the measurement subject car is not in service, the measurement subject car is switched to an out-of service state. When the measurement subject car stops being in service after it is determined initially in S102 that the measurement subject car is in service, the measurement subject car is switched to the out-of service state (S103). Once the measurement subject car has been switched to the out-of service state, the measurement subject car does not respond even when a call is registered.

Next, the start condition determination unit 15 determines whether or not the measuring car is in service (S104). When the measuring car is not in service, the measuring car is switched to the out-of service state. When the measuring car stops being in service after it is determined initially in S104 that the measuring car is in service, the measuring car is switched to the out-of service state (S105). Once the measuring car has been switched to the out-of service state, the measuring car does not respond even when a call is registered. When the measurement subject car and the measuring car have both been switched to the out-of service state, the start condition is established.

The measuring car is a car provided with a detector that detects a position of an elongated object. The measurement subject car is a car of an elevator including the elongated object whose position is to be detected. A case in which the car 1 is the measuring car will be described below as an example. The car 6 serves as the measurement subject car. Note that when the car 1 is the measurement subject car, the car 6 serves as the measuring car.

When the start condition is established in S105, the operation control unit 19 moves the car 1 to a bottom floor (S106). When the car 1 reaches the bottom floor, the operation control unit 19 moves the car 1 to a top floor (S107). The operation control unit 19 stops the car 6 from the point at which the car 1 departs frost the bottom floor to the point at which the car 1 arrives at the top floor. The detector 11 detects the position of the main rope 9 while the car 1 moves from the bottom floor to the top floor (S108). The detection operation of the detector 11 is performed while the car 1 moves, for example. The detector 11 detects the position of the main rope 9 at a plurality of heights.

The amplitude calculation unit 16 calculates the amplitude of the main rope 9 every time the detector 11 detects the position of the main rope 9 (S109). The operation control unit 19 stops the car 1 on the top floor (Yes in S110). When the car 1 reaches the top floor, the sway detection unit 17 determines whether or not the main rope 9 is swaying abnormally.

FIGS. 8 and 9 are diagrams for explaining a sway determination function of the control device 13. For example, the sway detection unit 17 determines whether or not the amplitude of the main rope 9, calculated by the amplitude calculation unit 16, exceeds a reference value R1 (S111). The reference value R1 is set in order to detect that it is necessary to implement the control operation. The reference value R1 is stored in advance in the storage unit 14.

When the amplitude calculated by the amplitude calculation unit 16 exceeds the reference value R1, the sway detection unit 17 detects that the main rope 9 is swaying abnormally. FIG. 8 shows an example in which the detector 11 detects the position of the main rope 9 at heights H1 to H4. In this case, the amplitude calculation unit 16 calculates the amplitude at the height H1, the amplitude at the height H2, the amplitude at the height H3, and the amplitude at the height H4. In a case where the amplitude calculation unit 16 calculates a plurality of amplitudes, the sway detection unit 17 detects that the main rope 9 is swaying abnormally (Yes in S111) when any one of the plurality of calculated amplitudes exceeds the reference value R1.

When the sway detection unit 17 detects that the main rope 9 is swaying abnormally, the operation control unit 19 starts the control operation in the elevator having the car 6 (S112). During the control operation, an operation is implemented on the assumption that long period vibration is occurring in the main rope 9, for example.

When none or the amplitudes calculated by the amplitude calculation unit 16 exceeds the reference value R1, the sway detection unit 17 determines whether or not any of the amplitudes calculated by the amplitude calculation unit 16 exceeds a reference value R2 (S201). The reference value R2 is a smaller value than the reference value R1. The reference value R2 is set in order to detect that high-precision measurement is required. The reference value R2 is stored in advance in the storage unit 14.

When none of the amplitudes calculated by the amplitude calculation unit 16 exceeds the reference value R2, the sway detection unit 17 detects that the main rope 9 is not swaying abnormally. In this case, the operation control unit 19 terminates the abnormality determination processing. The operation control unit 19 removes an assignment prohibition applied to the car 1. As a result, service by the car 1 is resumed. The operation control unit 19 removes art assignment prohibition applied to the car 6. As a result, service by the car 6 is resumed (S202).

FIG. 8 shows an example in which the amplitude in a zone L1 exceeds the reference value R1. However, the amplitude does not exceed the reference value R1 at any of the heights H1 to H4 at which detection is performed by the detector 11. In this case, the sway detection unit 17 determines in S111 that the calculated amplitude does not exceed the reference value R1. On the other hand, the amplitude at the height H2 and the amplitude at the height H3 exceed the reference value R2. Therefore, the sway detection unit 17 determines in S201 that the amplitude exceeds the reference value R2.

When the amplitude calculated by the amplitude calculation unit 16 exceeds the reference value R2 but does not exceed the reference value R1, the abnormality determination processing is executed at low speed. In a case where a plurality of amplitudes are calculated by the amplitude calculation unit 16, the low-speed abnormality determination processing is started when any one of the plurality of calculated amplitudes satisfies the above condition.

First, the measurement zone setting unit 18 calculates a zone in which position detection is to be performed again by the detector 11 (S203). This zone will be referred to hereafter as a "low speed measurement zone". For example, the low speed measurement zone is set to be shorter than the zone in which the car 1 is moved from S107 to S110. Further, the low speed measurement zone is set to include the heights at which the amplitudes exceeding the reference value R2 were calculated. In the example shown in FIG. 8, the low speed measurement zone is set as a zone including the height H2 and the height H3.

The measurement zone setting unit 18 may predict a point at which the amplitude of the main rope 9 reaches a maximum, and set the vicinity of this point as the low speed measurement zone. The measurement zone setting unit 18 may also set a plurality of zones as low speed measurement zones.

Once the low speed measurement zone has been set in S203, the operation control unit 19 moves the car 1 to a start position of the low speed measurement zone (S204). When the car 1 reaches the start position of the low speed measurement zone, the operation control unit 19 moves the car 1 to an end position of the low speed measurement zone (S205). At this time, the operation control unit 19 moves the car 1 at low speed. For example, the operation control unit 19 moves the car 1 at a lower speed than the speed at which the car 1 is moved from S107 to S110. The operation control unit 19 stops the car 6 from the point at which the car 1 departs from the start position of the low speed measurement zone to the point at which the car 1 arrives at the end position. The detector 11 detects the position or the main rope 9 while the car 1 moves through the low speed measurement zone (S206). The detection operation of the detector 11 is performed while the car 1 moves at low speed, for example. The detector 11 detects the position of the main rope 9 at a plurality of heights.

The amplitude calculation unit 16 calculates the amplitude of the main rope 3 every time the detector 11 detects the position of the main rope 9 (S207). The operation control unit 19 stops the car 1 at the end position of the low speed measurement zone (Yes in S208). When a plurality of zones are set as low speed measurement zones, the processing of S204 to S208 is implemented on each set zone (S209). Once the processing of S204 to S208 has been implemented on all of the low speed measurement zones, the sway detection unit 17 determines whether or not the main rope 9 is swaying abnormally.

The sway detection unit 17 determines whether or not the amplitude of the main rope 9, calculated by the amplitude calculation unit 16, exceeds a reference value R1 (S210). When the amplitude calculated by the amplitude calculation unit 16 exceeds the reference value R1, the sway detection unit 17 detects that the main rope 9 is swaying abnormally. When the sway detection unit 17 detects that the main rope 9 is swaying abnormally, the operation control unit 19 starts the control operation in the elevator having the car 6 (S112).

FIG. 9 shows an example in which a zone L2 extending from a height H5 to a height H10 is set as the low speed measurement zone. The zone L2 includes the height H2 and the height H3. The detector 11 detects the position of the main rope 9 at the heights H5 to H10, for example. The amplitude calculation unit 16 calculates the amplitude at the height H5, the amplitude at the height H6, the amplitude at the height H7, the amplitude at the height H8, the amplitude at the height H9, and the amplitude at the height H10. In a case where the amplitude calculation unit 16 calculates a plurality of amplitudes, the sway detection unit 17 detects that the main rope 9 is swaying abnormally (Yes in S210) when any one of the plurality of calculated amplitudes exceeds the reference value R1.

When none of the amplitudes calculated by the amplitude calculation unit 16 exceeds the reference value R1, the sway detection unit 17 detects that the main rope 9 is not swaying abnormally. In this case, the operation control unit 19 terminates the abnormality determination processing. The operation control unit 19 removes the assignment prohibition applied to the car 1. As a result, service by the car 1 is resumed. The operation control unit 19 removes the assignment prohibition applied to the car 6. As a result, service by the car 6 is resumed (S202).

With the elevator system having the functions described above, swaying occurring in an elongated object can be detected with a high degree of precision. In the example illustrated in this embodiment, the detector 11 detects the position of the main rope 9. Abnormal swaying occurring in the main rope 9 can then be detected on the basis of the position detected by the detector 11. Further, the detector 12 detects the position of the main rope 4. Abnormal swaying occurring in the main rope 4 can then be detected on the basis of the position detected by the detector 12. Hence, there is no need to use detectors having long measurement ranges as the detectors 11 and 12. Since a detector steadily increases in price as the measurement range thereof increases, the system can be constructed at low cost. The present invention is particularly effective as a system provided in a high-rise building.

In this embodiment, an example in which the abnormality determination processing is executed at low speed when a negative determination is obtained in S111 of FIG. 6 was described. Instead of executing the abnormality determination processing at low speed, service may be resumed when a negative determination is obtained in S111 of FIG. 6 (S202). By executing the abnormality determination processing at low speed, however, the detection precision can be improved.

In this embodiment, an example in which a requirement for satisfying the start condition is that both the measurement subject car and the measuring car are in the out-of service state was described. However, the requirement for satisfying the start condition may be that both the measurement subject car and the measuring car are not currently in service. The abnormality determination processing may be interrupted when a call is assigned to the measurement subject car or the measuring car.

In this embodiment, an example in which position detection by the detector 11 is executed while the car 1 moves was described. Instead, the car 1 may be stopped while the detector 11 executes position detection. However, when long period vibration occurs, the car 1 also sways. By moving the car 1, a constant tension can be applied to the main rope 4, and as a result, vibration of the car 1 can be suppressed. In other words, by having the detector 11 execute position detection while moving the car 1, the detection precision can be improved.

In this embodiment, an example in which the abnormality determination processing is executed on the adjacent elevator was described. In a case where the system includes three or more elevators, the abnormality determination processing may be implemented on an elevator that is not adjacent.

The present invention may be applied to a so-called one-shaft multi-car elevator system. In this system, a plurality of cars are disposed vertically. For example, an upper car is disposed above a lower car. The lower car and the upper car move vertically in the same shaft. The lower car does not stop on the top floor. The upper car does not stop on the bottom floor. The elongated object that moves as the lower car moves is also disposed at the side of the upper car. Therefore, the position of this elongated object can be detected by the detector provided on the upper car. Similarly, the elongated object that moves as the upper car moves is also disposed at the side of the lower car. Therefore, the position of this elongated object can be detected by the detector provided on the lower car.

Other functions that may be exhibited by the control device 13 will now foe described.

The control device 13 may include a probability calculation unit 20 and a condition setting unit 21. The probability calculation unit 20 calculates a probability of abnormal swaying occurring in the elongated object. In the example illustrated in this embodiment, the probability calculation unit 20 calculates the probability of abnormal swaying occurring in the main rope 4 or 9. Any method may be employed by the probability calculation unit 20 to calculate the probability. For example, the probability calculation unit 20 may calculate the probability on the basis of information from an anemometer provided on the outside of the building. The probability calculation unit 20 may calculate the probability on the basis of information such as an earthquake warning received from the outside.

The condition setting unit 21 sets a start condition on the basis of the probability calculated by the probability calculation unit 20, for example. When it is determined that long period vibration is likely to occur in the elongated object, the condition setting unit 21 ensures that the abnormality determination processing is executed frequently. For example, the condition setting unit 21 sets the start condition such that the abnormality determination processing is executed steadily more frequently as the probability calculated by the probability calculation unit 20 increases.

The control device 13 may also include a damage estimation unit 22. The damage estimation unit 22 estimates damage caused by abnormal swaying of the elongated object. When the elongated object sways abnormally, the elongated object itself may be damaged. Further, when the elongated object comes into contact with a device, the device may be damaged. For example, the damage estimation unit 22 estimates damage to the elongated object or damage to a device with which the elongated object may come into contact.

The damage estimation unit 22 estimates the damage on the basis of the amplitude calculated by the amplitude calculation unit 16, for example. The amplitude calculated by the amplitude calculation unit 16 is stored in the storage unit 14 in association with the height information. The damage estimation unit 22 uses the information accumulated in the storage unit 14 to estimate the nature of vibration occurring in the elongated object.

By providing these functions, maintenance operations can be implemented on the system efficiently. For example, an estimation result obtained by the damage estimation unit 22 may be used to determine inspection points on the elongated object and inspection points on the device. The estimation result obtained by the damage estimation unit 22 may also be used to determine priority inspection points. Further, the estimation result obtained by the damage estimation unit 22 may be used to determine a time to replace the elongated object and a time to replace the device.

Each of the units having the reference numerals 14 to 22 denotes a function of the control device 13. FIG. 10 is a diagram showing hardware components of the control device 13. The control device 13 includes, as a hardware resource, circuitry including an input/output interface 23, a processor 24, and a memory 25, for example. The control device 13 realizes each function of the units 14 to 22 by having the processor 24 execute a program stored in the memory 25. The control device 13 may include a plurality of processors 24. The control device 13 may include a plurality of memories 25. In other words, each function of the units 14 to 22 may be realized by the plurality of processors 24 and the plurality of memories 25 in conjunction. Some or all functions of the units 14 to 22 may be realized by hardware.

INDUSTRIAL APPLICABILITY

The elevator system according to the present invention may be applied to a system including a plurality of cars.

REFERENCE SIGNS LIST

1, 6 car
2, 7 shaft
3, 8 counterweight
4, 9 main rope
5, 10 traction machine
5*a*, 10*a* driving sheave
11, 12 detector
13 control device
14 storage unit
15 start condition determination unit
16 amplitude calculation unit
17 sway detection unit
18 measurement zone setting unit
19 operation control unit
20 probability calculation unit
21 condition setting unit
22 damage estimation unit
23 input/output interface
24 processor
25 memory

The invention claimed is:

1. An elevator system comprising:
a first car that moves vertically;
an elongated object that moves as the first car moves;
a second car that moves vertically;
a detector provided on the second car in order to detect a position of the elongated object; and
circuitry to detect, on the basis of the position detected by the detector, that abnormal swaying requiring a control operation is occurring in the elongated object.

2. The elevator system according to claim 1, wherein the circuitry is configured to detect that abnormal swaying is occurring in the elongated object on the basis of the position detected by the detector while the first car is stopped and the second car is moving.

3. The elevator system according to claim 2, wherein the circuitry is configured to calculate an amplitude of the elongated object on the basis of the position detected by the detector while the first car is stopped and the second car is moving, and detect that abnormal swaying is occurring in the elongated object when the calculated amplitude exceeds a first reference value;

when the calculated amplitude at a time of movement of the second car at a first speed exceeds a second reference value but does not exceed the first reference value, the second car is moved at a second speed and then the amplitude of the elongated object is calculated;

the second reference value is smaller than the first reference value; and the second speed is lower than the first speed.

4. The elevator system according to claim 3, wherein a zone in which the second car moves at the second speed includes a height at which the amplitude exceeding the second reference value is calculated, and is shorter than a zone in which the second car moves at the first speed.

5. The elevator system according to claim 1, wherein the circuitry is configured to calculate an amplitude of the elongated object on the basis of the position detected by the detector; and estimate damage to the elongated object or damage to a device with which the elongated object may come into contact, on the basis of the calculated amplitude.

6. The elevator system according to claim 1, wherein the second car is disposed above or below the first car, and the first car and the second car move in an identical shaft.

7. The elevator system according to claim 1, wherein the circuitry is configured to calculate a probability of abnormal swaying occurring in the elongated object; and set a start condition on which processing for implementing detection based on the position detected by the detector is started, on the basis of the calculated probability.

8. The elevator system according to claim 7, wherein the circuitry is configured to set the start condition such that the processing is executed steadily more frequently as the calculated probability increases.

9. The elevator system according to claim 1, further comprising:

a second elongated object that moves as the second car moves; and a second detector provided on the first car in order to detect a position of the second elongated object, wherein the circuitry is configured to detect, on the basis of the position detected by the second detector, that abnormal swaying requiring a control operation is occurring in the second elongated object.

* * * * *